US007726589B2

(12) United States Patent
Roumanis

(10) Patent No.: US 7,726,589 B2
(45) Date of Patent: Jun. 1, 2010

(54) HAND HELD DUAL NOZZLE SPRAY GUN AND SYSTEM

(76) Inventor: Georgio Roumanis, 8425 Rimbaud, Brossard, Quebec (CA) J4X-1R4

( * ) Notice: Subject to any disclaimer, the term of this patent is extended or adjusted under 35 U.S.C. 154(b) by 90 days.

(21) Appl. No.: 11/419,686

(22) Filed: May 22, 2006

(65) Prior Publication Data

US 2007/0267523 A1 Nov. 22, 2007

Related U.S. Application Data

(60) Provisional application No. 60/747,633, filed on May 18, 2006.

(51) Int. Cl.
*B05B 7/02* (2006.01)
*B05B 7/12* (2006.01)

(52) U.S. Cl. ..... 239/525; 239/569; 239/413

(58) Field of Classification Search ..... 239/525–528, 239/436, 443, 444, 548, 549, 551, 562, 8, 239/11, 413, 398, 569; 426/427; 118/300, 118/302

See application file for complete search history.

(56) References Cited

U.S. PATENT DOCUMENTS 3,801,009 A * 4/1974 Marshall, III ..... 239/9
4,745,011 A * 5/1988 Fukuta et al. ..... 427/426
5,080,283 A * 1/1992 Kukesh et al. ..... 239/9
5,419,491 A * 5/1995 Breitsprecher ..... 239/9
6,126,088 A * 10/2000 Wilger et al. ..... 239/170
6,663,021 B1 * 12/2003 Scarpa et al. ..... 239/424

* cited by examiner

*Primary Examiner*—Davis Hwu
(74) *Attorney, Agent, or Firm*—Fay Sharpe LLP

(57) ABSTRACT

A spray gun for applying an electroless plating solution includes a handle, a trigger connected to the handle, a nozzle assembly connected to the handle, a first fluid passage, a second fluid passage, a switch, and a valve assembly. The nozzle assembly includes a first fluid path having a first outlet and a second fluid path having a second outlet. The first fluid passage is in communication with the first outlet of the nozzle. The second fluid passage is in communication with the second outlet of the nozzle. The switch is selectively activated by the trigger upon movement of the trigger. The valve assembly is in fluid communication with the first fluid passage and the second fluid passage. The valve assembly includes a valve and a solenoid. The valve is operable between an open position and a closed position. The solenoid is in electrical communication with the switch and an associated power source. The switch controls the delivery of power to the solenoid and the solenoid operates the valve. A system for applying an electroless plating solution is also disclosed.

6 Claims, 5 Drawing Sheets

HAND HELD DUAL NOZZLE SPRAY GUN AND SYSTEM

This application claims the benefit of provisional Application Ser. No. 60/747,633, filed 18 May 2006, which is incorporated by reference.

BACKGROUND

A "chrome" finish is typically applied using a conventional electroplating technique. Chrome finishes are specified on a variety of products, such as shower heads and car door handles. One drawback of conventional electroplated chrome finishes is that the finish can only be applied onto a limited range of substrates. There are also constraints with regard to the size and geometry of work pieces that can be finished, as well as drawbacks related to the toxic nature of the chemicals and expense and complexity of the machines and procedures needed to perform the electroplating process.

A spray-on electroless system for providing a chrome like finish has been developed to overcome the aforementioned shortcomings of the electroplating technique. This electroless system uses two water-based solutions that are applied to the work piece using a dual nozzle spray gun. Specific to the aforementioned electroless system, the first liquid is a silver nitrate solution and the second liquid is referred to as a reducer. For the finish to look as good as possible, equal parts of each liquid mix downstream the respective outlets of the dual nozzle spray gun prior to contacting the work piece.

A known two nozzle spray gun has been used to apply both the liquids onto the work piece. One liquid, e.g. silver nitrate solution, travels through a first nozzle and second liquid, i.e. reducer, travels through a second nozzle. These known spray guns include a needle valve that moves in and out of the respective outlets of the dual nozzle spray gun. The needle valve is mechanically actuated by the user of the spray gun depressing a trigger. By using mechanical actuation, the needle valves may not open simultaneously. The valves also may not open the same distance. Such mechanical actuation can result in the flow path through one of the nozzles being larger than the flow path through the other nozzle therefore affecting the mixture ratio of the mixed solution that contacts the work piece. Additionally, the needle valves can become clogged, especially the needle valve through which the silver nitrate, which includes particulates, travels.

SUMMARY OF THE INVENTION

A spray gun for applying an electroless plating solution includes a handle, a trigger connected to the handle, a nozzle assembly connected to the handle, a first fluid passage, a second fluid passage, a switch, and a valve assembly. The nozzle assembly includes a first fluid path having a first outlet and a second fluid path having a second outlet. The first fluid passage is in communication with the first outlet of the nozzle. The second fluid passage is in communication with the second outlet of the nozzle. The switch is selectively activated by the trigger upon movement of the trigger. The valve assembly is in fluid communication with the first fluid passage and the second fluid passage. The valve assembly includes a valve and a solenoid. The valve is operable between an open position and a closed position. The solenoid is in electrical communication with the switch and an associated power source. The switch controls the delivery of power to the solenoid and the solenoid operates the valve.

A system for applying an electroless plating solution includes a dual nozzle spray gun and a control. The dual nozzle spray gun is for applying an electroless plating solution to an associated work piece. The control is configured to operate between a first operating position and a second operating position. When in the first operating position, the spray gun is in communication with a first fluid source and a second fluid source. When in the second operating position, the spray gun is in communication with a third fluid source.

A method of operating a finishing gun for an electroless plating system includes the following steps: connecting a dual nozzle spray gun to a control spaced upstream from the spray gun; connecting the control to a silver nitrate source, a reducer source, an air source and a water source; placing the control in an operating position such that the spray gun is in fluid communication with at least one of the silver nitrate source, the reducer source, the air source and the water source; and selectively dispensing at least one of silver nitrate, reducer, air and water from the spray gun.

DETAILED DESCRIPTION

Figure 1:
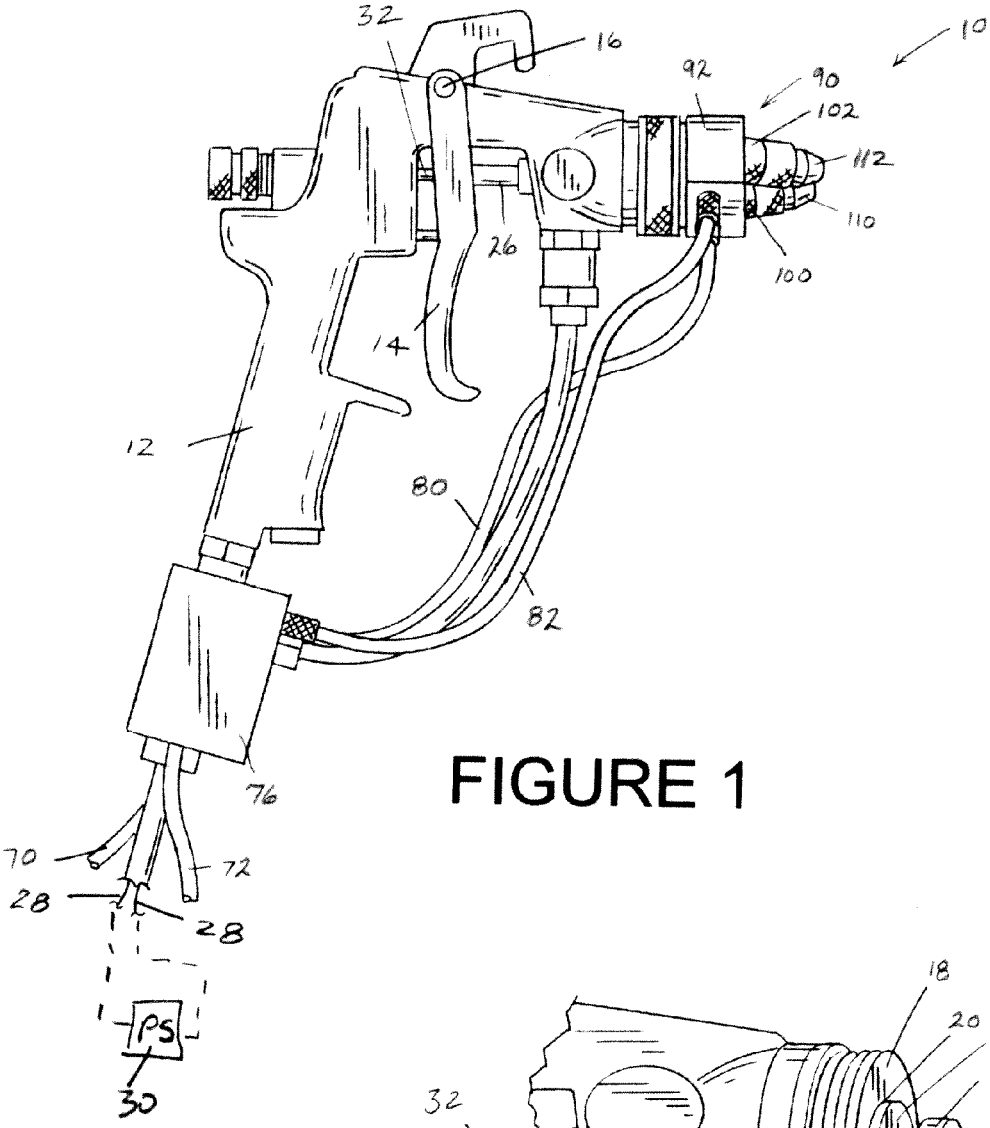
FIG. 1 is a side elevation view of a spray gun for use in an electroless plating system.

With reference to FIG. 1, a dual nozzle spray gun 10 will be described for applying a silver nitrate solution and a reducer solution to apply a finish to a work piece. The dual nozzle spray gun 10 is not limited to delivering only silver nitrate solution and the reducer solution to a work piece. Additionally, the gun 10 is useful for other applications.

The gun 10 includes a handle 12 and a trigger 14 that connects to the handle. In the depicted embodiment, the trigger 14 pivots about a pin 16 and is movable between a depressed and a released (shown in FIG. 1) state. The gun 10 depicted in FIG. 1 is a modified spray gun of the type that typically included mechanically actuated needle valves.

Figure 2:
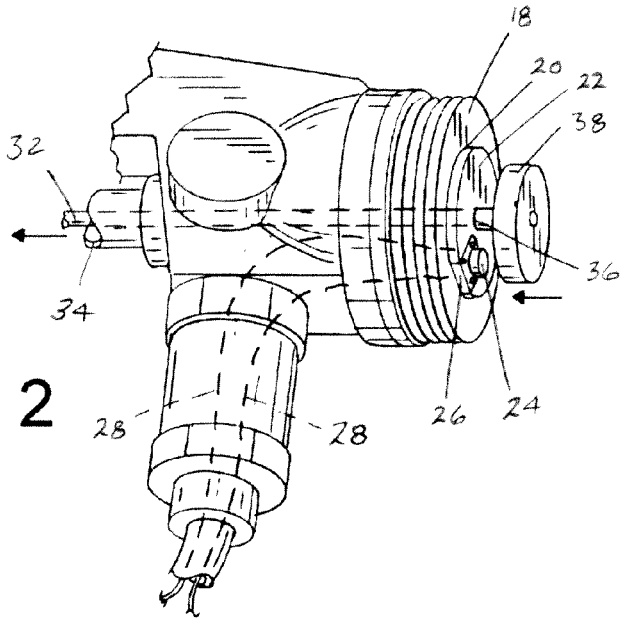
FIG. 2 is a close-up view of a portion of the spray gun of FIG. 1 with a nozzle assembly removed.

With reference to FIG. 2, the gun has been modified to include an insert 18 that is threaded into an opening at the front end of the gun. The insert 18 includes an opening 20 that receives a switch mounting plate 22. A button 24 operates a switch 26 connected to electrical wires 28, which are connected to a power source 30 which can include a low voltage (12-24 volt) DC or AC power source to selectively control the dispensing of the solutions onto a work piece in a manner that will be described in more detail below. The switch 26 and button 24 mount to the switch mounting plate 22.

A rod 32 connects to the trigger 14. In the depicted embodiment, the rod 32 is disposed in a cylindrical sleeve 34 to protect the rod. The rod 32 is received through an opening 36 in the switch mounting plate 22, A plunger 38 attaches to a distal end of the rod 24. The plunger 38 is configured to contact the button 24 when the trigger 14 is depressed. In the depicted embodiment, when the switch 26 is closed, the first and second liquid solutions, i.e. the silver nitrate solution and the reducer solution, are sprayed from the spray gun 10.

Figure 3:
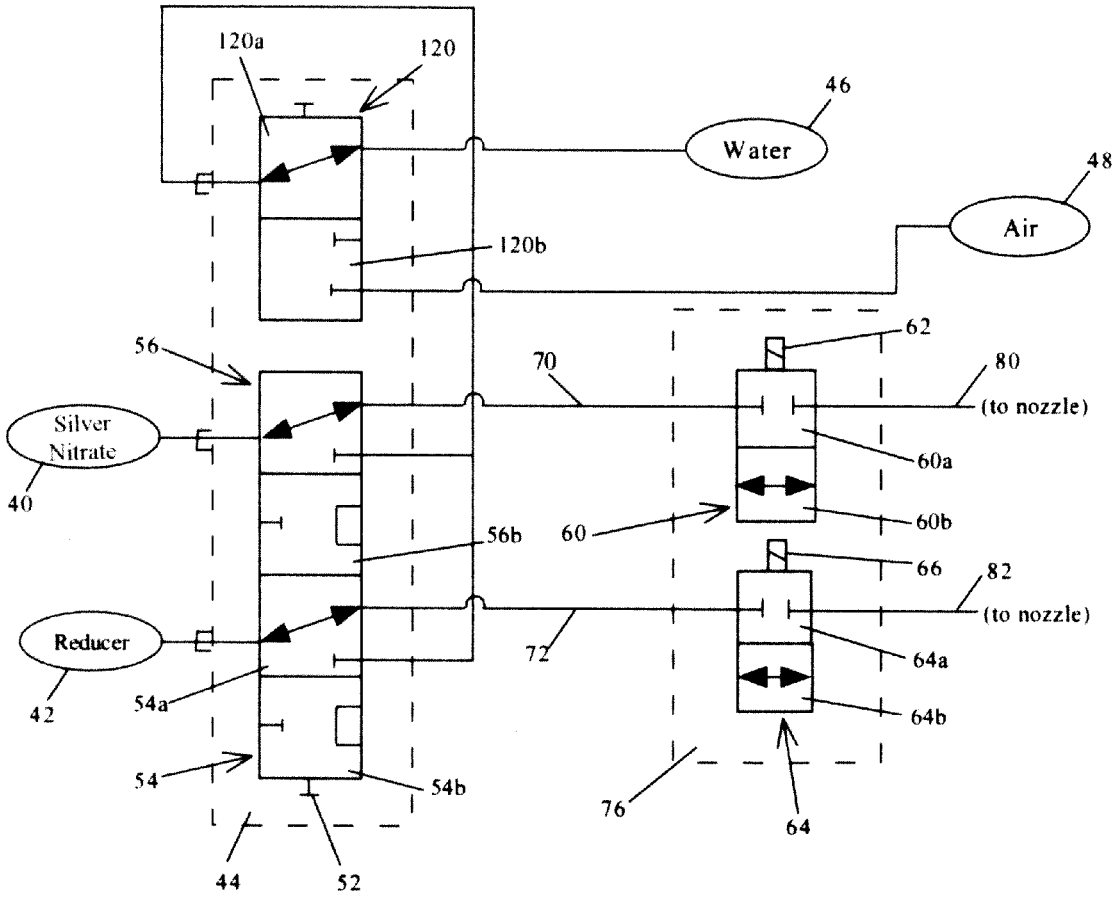
FIG. 3 is a schematic view of a hydraulic circuit for the electroless plating system.

A system for applying a sprayed-on electroless plating finish onto a work piece includes the gun 10 (FIG. 1) as well as other components described in FIG. 3. A pressurized silver nitrate source 40 and a pressurized reducer source 42 communicate with a control 44 (depicted schematically). A pressurized water source 46 and a pressurized air source 48 also communicate with the control 44. The pressurized sources 40, 42, 46 and 48 can be tanks, which are known in the art. A pump (not shown), a type which is known in the art, powered by an associated AC or DC power source, which can be power source 30, can be used to pressurize the fluid sources 40, 42, 46 and 48. The control 44 is depicted as being contained in a single housing; however, this is not required.

In the embodiment depicted in FIG. 3, the control 44 includes a plurality of valves; each are operable between at least two operating positions. In the depicted embodiment a lever 52 controls the movement of valve sets 54 and 56. More than one lever can be provided. In the first operating position depicted at 54*a* and 56*a*, respectively, the silver nitrate source 40 is in communication with a first solenoid valve 60 that is operable between two operating positions 60*a* and 60*b*. A solenoid 62, which is in electrical communication with the switch 26 via electrical wires 28 (FIG. 2) operates the first valve 60. The solenoid 62 is powered by an associated AC or DC power source (not shown). A controller (not depicted) can be interposed between the solenoid and the power source. The controller can indicate to the user via a signal (e.g. audible) to indicate low power.

With reference back to the control 44, when the first valve set 54 is in the first operating position 54*a*, the reducer source 42 communicates with a second solenoid valve 64 which is operable between two operating positions 64*a* and 64*b*. The second valve 64 is also operated by a solenoid 66 that is in electrical communication with the switch 22 (FIG. 2). The solenoid 66 is powered by an associated AC or DC power source (not shown). When the first and second valve sets of the control 44 are in the first operating position the silver nitrate and reducer liquid pass through the control 44, through lines 70 and 72 respectively (see also FIG. 1) into a solenoid valve housing 76 (see also FIG. 1) that is attached to a lower end of the handle 12. Attaching the valve housing 76 to the lower end of the handle 12 allows the front end portion of the spray gun 10 to remain lightweight so that the gun can be easily handled by an individual. The lines 70 and 72 communicate with respective solenoid valves 60 and 64. A silver nitrate gun line 80 communicates with a downstream end of the first valve 60 and the reducer gun line 82 communicates with a downstream end of the second valve 64.

Figure 4:
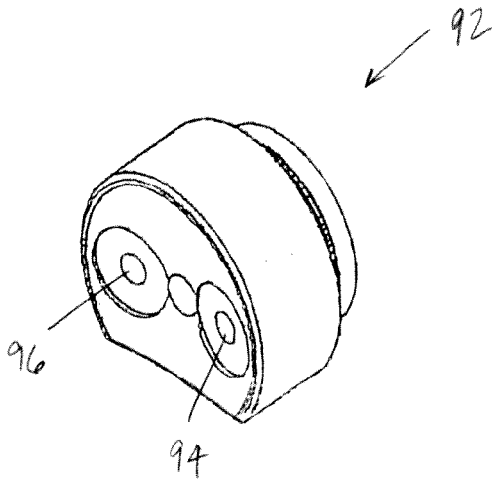
FIG. 4 is a perspective view of a nozzle adapter for the spray gun shown in FIG. 1.
Figure 5:
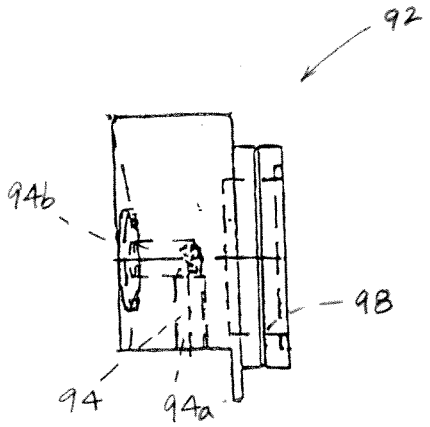
FIG. 5 is a side elevation view of the adapter of FIG. 4 with internal passages shown in phantom.

Fluid lines 80 and 82 attach to a nozzle assembly 90 (FIG. 1) located at a front end of the spray gun 10. Unlike known dual spray guns that include a needle valve in the nozzle assembly, the nozzle assembly 90 in the depicted embodiment does not include any moving parts in its fluid path. The nozzle assembly 90 includes a nozzle adapter 92 (see also FIGS. 4 and 5) that includes first and second passages 94 and 96 (FIG. 4), respectively, through which fluid flows. In the depicted embodiment, each fluid passage can be described as having a vertical leg 94*a* and a horizontal leg 94*b* (the vertical and horizontal legs of the second passage 96 are not visible but are similar to those depicted in FIG. 5). The silver nitrate fluid line 80 (FIG. 1) communicates with the vertical leg 94*a* of the first passage 94*a* and the reducer fluid line 82 (FIG. 1) communicates with the second vertical leg of the second passage 96. The nozzle adapter 92 includes a threaded rear opening 98 for receiving the insert 18 (FIG. 2).

Figure 6:
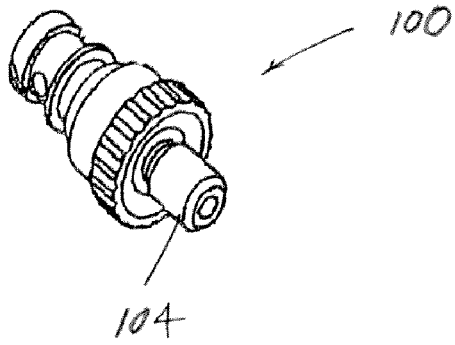
FIG. 6 is a perspective view of a nozzle for the spray gun depicted in FIG. 1.
Figure 7:
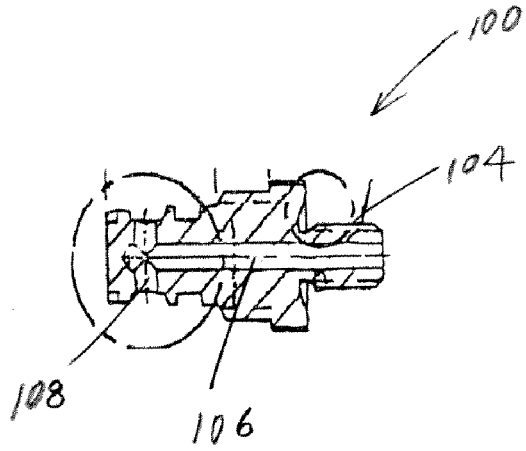
FIG. 7 is a cross-sectional view of the nozzle depicted in FIG. 6.

With reference back to FIG. 1, nozzles 100 and 102 are each received inside a respective horizontal leg of the first and second passages 94 and 96 of the nozzle adapter 92. Each nozzle is similarly configured; therefore, only the first nozzle will be described with particularity with reference to FIGS. 6 and 7. In the depicted embodiment, the first nozzle 100 includes a threaded portion 104 that is received inside the horizontal leg 94*b* (FIG. 5) of the first passage 94. The nozzle 100 includes a longitudinal passage 106 that intersects a radial passage 108 that travels through a distal end portion of the nozzle 100.

Figure 8:
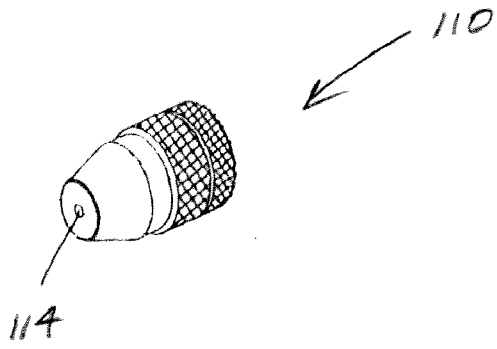
FIG. 8 is a perspective view of a nozzle cap for the spray gun depicted in FIG. 1.
Figure 9:
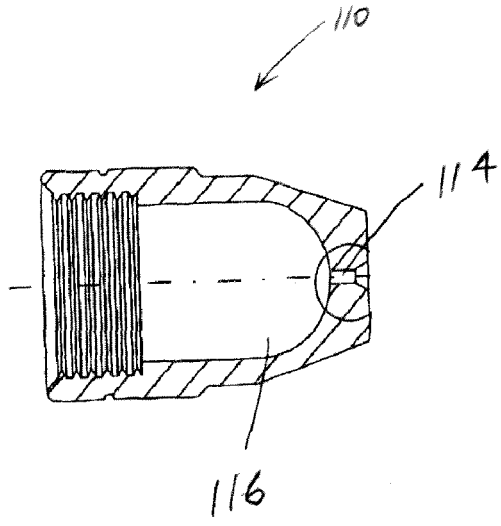
FIG. 9 is a cross-sectional view of the nozzle cap depicted in FIG. 8.

With reference to FIG. 1, a nozzle cap 110 and 112 fits over the distal portion of each nozzle 100 and 102. The nozzle caps have the same configuration; therefore, only the first nozzle cap 110 will be described with particularity with reference to FIGS. 8 and 9. The nozzle cap 110 includes a nozzle outlet opening 114 in communication with an internal chamber 116 of the nozzle cap that receives the nozzle 100.

With reference back to FIG. 3, when the control 44 is in the first operating position and the trigger 14 (FIG. 1) is depressed activating the solenoids 62 and 66, silver nitrate travels from the silver nitrate source 40 through the control 44 and through the solenoid valve 60 towards the nozzle assembly 90 (FIG. 1) where it travels through the first passage 94 in the nozzle adapter 92 and through the longitudinal passage 106 of the nozzle 100 into the radial passage 108 which is in communication with the internal chamber 116 and thus through the nozzle outlet 114. Similarly, reducer liquid from the reducer source 42 travels through the control 44 and through the valve 64 towards the nozzle adapter 92. The reducer travels a similar path through the nozzle 102 and the nozzle cap 112. Using electrically actuated solenoid valves (one valve could be used for each line) facilitates simultaneous opening of the respective fluid passages through the valves thus facilitating the desired equal parts silver nitrate to reducer mixture downstream from the outlets of the gun. More particularly, to achieve a high quality application of material in the spray-on electroless system, the amount of the first liquid, e.g. silver nitrate solution, to the second liquid is each between 47%-53%, or more preferably 49%-51%. The more imprecise the ratio of reducer to silver nitrate, the more the silver nitrate appears more yellow. When outside of these amounts, the quality of the application deteriorates. The described gun has therefore been designed to greatly increase the likelihood that the fluid mixture that contacts the work piece from the respective nozzles in within the aforementioned comparative amounts. The solenoid valves can be of the type that pinch a fluid line with the use of the moving portion of the solenoid, which also eliminates, or greatly reduces, the likelihood of blockage in the solenoid valves.

With reference back to FIG. 3, the water source 46 and the air source 48 are provided to clean the spray gun 10. The control 44 includes a third valve component 120 that operates between a first operating position 120*a* and a second operating position 120*b*. When in the first operating position 120*a* water, which will typically be deionized water, from the water source 46 is delivered to the first valve component 54 and the second valve component 56 of the control 44. To clean the gun 10, the first and second valve components 54 and 56 are moved into their second mode of operation 54*b* and 56*b* respectively. When the first and second valve components 54 and 56 are in the second mode of operation, water is delivered through fluid lines 70 and 72 towards the respective solenoid valves 60 and 64, which can be opened via solenoids 62 and

66, to clean the nozzle assembly downstream from the respective solenoid valves. The third valve component 120 of the control 44 can move into the second mode of operation 120*b* where air 48 is delivered via the same path as the water described above. Providing such a control, allows the user of the spray gun to easily clean the spray gun without having to attach and reattach water and air lines to the spray gun each time he desires to clean the gun.

A spray gun and a system for applying coating materials to a work piece has been described with reference to certain embodiments. Modifications and alterations will occur to those upon reading and understanding the detailed description. The invention is not limited to only those embodiments depicted in the preceding description. Instead, the invention is broadly defined by the appended claims and the equivalents thereof.

The invention claimed is:

1. A system for applying an electroless plating solution, the system comprising:

a silver nitrate source;

a reducer source;

a water source;

a dual nozzle spray gun for applying an electroless plating solution to an associated workpiece, the spray gun including a handle;

a trigger connected to the handle;

a nozzle assembly connected to the handle, the nozzle assembly including a first fluid path having a first outlet and a second fluid path having a second outlet;

a first fluid passage in communication with the first outlet of the nozzle assembly;

a second fluid passage in communication with the second outlet of the nozzle assembly;

a switch selectively activated by the trigger upon movement of the trigger;

a valve assembly in fluid communication with the first fluid passage and the second fluid passage, the valve assembly including first and second valves and first and second solenoids, the first valve controlling the delivery of silver nitrate toward the first fluid outlet and the second valve controlling the delivery of reducer toward the second fluid outlet, wherein the valve assembly selectively opens the first valve and the second valve simultaneously so that silver nitrate from the first outlet and reducer from the second outlet exit at substantially the same time and mix downstream from the outlets such that a fluid mixture reaching an associated work piece comprises 48%-52% of silver nitrate from the first outlet and 48%-52% of reducer from the second outlet; and a control configured to operate between a first operating position and a second operating position, when in the first operating position the spray gun being in communication with the silver nitrate source and the reducer source through the control and the outlets of the spray gun being blocked from the water source and when in the second operating position the outlets of the spray gun being blocked from the silver nitrate source and the reducer source through the control and the outlets of the spray gun being in communication with the water source through the control;

wherein the spray gun is a modified spray gun that included a mechanically actuated needle valve, the spray gun includes an insert threaded into an opening at a front end of the gun and a switch mounting plate connected to the insert, the spray gun further including a button mounted to the switch mounting plate, a rod connected to the trigger and a plunger connected to the rod, wherein the plunger contacts the button when the trigger is depressed to close the switch.

2. The system of claim 1 further comprising an air source, wherein the control is configured to operate in a third operating position, when in the third operating position the outlets of the spray gun are blocked from the from the silver nitrate source, the reducer source and the water source through the control and are in communication with the air source through the control.

3. The system of claim 2, wherein when the control is in the second operating position the spray gun is blocked from the air source.

4. The system of claim 1, further comprising a valve housing for the valve assembly, the valve housing being attached to a lower end of the handle.

5. The system of claim 1, wherein the nozzle assembly does not include any moving parts in the fluid paths.

6. The system of claim 1, wherein the spray gun does not include a needle valve.

* * * * *